US006994172B2

(12) United States Patent
Ray

(10) Patent No.: US 6,994,172 B2
(45) Date of Patent: Feb. 7, 2006

(54) WELL DRILLING CONTROL SYSTEM

(76) Inventor: James Ray, 915 E. Co. Rd. 125, Midland, TX (US) 79706

( * ) Notice: Subject to any disclaimer, the term of this patent is extended or adjusted under 35 U.S.C. 154(b) by 0 days.

(21) Appl. No.: 10/178,802

(22) Filed: Jun. 24, 2002

(65) Prior Publication Data

US 2003/0234119 A1 Dec. 25, 2003

(51) Int. Cl.
*E21B 19/00* (2006.01)

(52) U.S. Cl. ..... 175/24; 175/27
(58) Field of Classification Search ..... 175/24, 175/26, 27, 162
See application file for complete search history.

(56) References Cited

U.S. PATENT DOCUMENTS 4,662,608 A * 5/1987 Ball ..... 254/273
5,474,142 A * 12/1995 Bowden ..... 175/27
6,209,662 B1 * 4/2001 Stahl ..... 175/27

FOREIGN PATENT DOCUMENTS

WO WO 94/24407 * 10/1994

* cited by examiner

*Primary Examiner*—William Neuder
(74) *Attorney, Agent, or Firm*—David Henry

(57) ABSTRACT

An improved oil and gas drilling control system which utilizes improved braking and feedback technology which, in turn, permits more precise weight-on-bit control and more smooth transitions of weight-on-bit than any existing technology. In addition, the system also permits more accurate feedback and control with respect to drilling depth, pipe transitions, and rate of penetration than prior systems.

3 Claims, 4 Drawing Sheets

10

WELL DRILLING CONTROL SYSTEM

BACKGROUND OF THE INVENTION

1. Field of the Invention

The present invention is directed to methods and apparatus for use with subterranean drilling systems. More specifically, the present invention is directed to systems to maintain a constant and desired weight on a drilling stem to maximize penetration and drilling rates.

2. Description of the Prior Art

In earth drilling, particularly the drilling of oil and gas wells, the control of the drilling operation has usually been accomplished manually. Conventional drilling rigs utilize a draw works which is powered by an engine and operates most of the motor driven portions of the rig. The draw works includes a drum with a drill line wound on it which is fed off to lower drill pipe as the drilling is accomplished. The drill line is looped through a crown block in a double pulley relationship and the end of the line is connected to a fixed point end called the dead line.

As the pipe is lowered into the well during drilling, the weight of the pipe string on the drill bit is measured by the tension in the drill line. The tension in the drill line is commonly measured by a pressure sensor which converts tension to weight indication through a hydraulic line extending to a bit weight gauge on the drilling console. The rate of feed out of the drill line from the drum controls the bit weight and to a large extent the rate of drilling. The rate of feed out of the drill line from the drum is controlled by a hand brake operated by a conventional brake lever. In manually-operated drilling rigs, the driller has to monitor the operation of the equipment and operate the brake from time to time in response to the indications of the bit weight gauge to control the rate of feed out of the drill line and thus attempt to keep a fairly constant bit weight.

In recent years, there have been developed a number of automatic drilling systems. These systems are automatic in the sense that they provide some form of automatic control over the equipment. Many of these automatic drillers operate from the air supply of the drilling rig en route to the drillers control station. The components involved are mainly air clutches with various types of air dump valves to exhaust used air.

One such device is disclosed in U.S. Pat. No. 4,491,186 ("the '186 patent") as issued to Adler. The apparatus disclosed in the '186 patent utilizes the rotation rate of a downhole mud motor as a parameter to determine the release of the drill string. While this invention has application to downhole mud motors, it requires the use of an in-hole tachometer which enhances operation cost.

Another automatic drilling system is disclosed in U.S. Pat. No. 5,474,142 ("the '142 patent") as issued to Bowden. The device illustrated in the '142 patent operates off of bit weight and fluid pressure which act on a pair of Bourden tubes. While such a device is nominally effective as an automatic driller, the use of the Bourdon tubes creates a time lag and limits its sensitivity due to the necessity for pressurization of hydraulic fluid.

Yet another system is illustrated in U.S. Pat. No. 5,713,422 as issued to Dhirdsa. This system suffers from the use of multiple sensing assemblies to determine and calculate the rate of penetration, which assemblies are maintenance intensive and are thus problematic for long term operation. Those in the drilling industry desperately need to have an automatic driller that would significantly improve the constancy of WOB, and make necessary changes with more smoothness (known as "peeling the drum") than is possible with existing systems and technology. The use of emerging bit technology such as PDC bits especially require a smooth action to prevent the breaking of expensive diamond cutters.

Also, the industry needs technology and systems which allow considerably faster drilling than is now possible. Existing automatic driller systems cannot be used in many circumstances, because the rate of penetration (ROP)is deemed to be too fast for conventional technology to keep up.

SUMMARY OF THE INVENTION

It is an object of the present invention to provide an improved drilling control system.

It is another object of the present invention to provide an improved drilling control system, which allows more precise control of weight on bit ("WOB")than presently available systems.

It is another object of the present invention to provide an improved drilling control system, which allows more smooth transitions in WOB than presently available systems.

It is another object of the present invention to provide an improved drilling control system, which allows as rapid drilling progress as strata allows, rather than, as is the case with present technology, being limited by limitations of the driller system itself.

It is another object of the present invention to provide an improved drilling control system, which allows for greater degrees of control, accuracy and feedback information on the progress of drilling depths, etc. than allowed by presently available technologies in the drilling technology realm.

It is another object of the present invention to provide solutions to each of the problems or limitations addressed in the Background of the Invention section, regardless of whether such are enumerated individually as an object of the present invention.

The driller system of present invention addresses each of the above objects and above-referenced problems, limitations and unmet desires in the drilling field.

In one preferred embodiment the present invention includes a system for controlling the release of a drill stem in a conventional drilling apparatus which includes a derrick with a crown block and a traveling block, a draw works and an engine where the draw works is powered by the engine and controlled by the clutch and brake. The draw works includes a drum on which is wound one end of a drill line which is wound up or released during the drilling operations.

The drill line extends through the crown block and traveling block and is connected at its opposite terminal end to a fixed point providing a deadline. The crown block and the traveling block form a pulley system for supporting a drill stem to raise or lower it during drilling operations. In this connection, when drill line is wound up on the drum, the traveling block is raised thereby raising the drill stem.

The system of the present invention provides means coupled to the deadline for obtaining a weight reading on the drill stem. This weight reading is usually in the form of an analog electrical signal. This analog electrical signal is supplied to a programmable logical controller, which transforms the analog electrical signal into a digital electrical signal. This electrical signal at a selected voltage or current is supplied to a gauging means in which has been programmed desired weight parameters. This gauging means then passes the signal to a control mechanism which uses an electric motor, coupled to a gearbox at the draw works. The motor's RPM rate depends on the voltage potential.

The present invention presents a number of advantages over prior art systems.

The electric motor mounted to a gearbox of the system of the present invention, under precise control of a computer unit, rotates at a substantially constant rate which is determined, by measurements of various parameters, to actuate the brake lever to a degree that a desired weight-on-bit is maintained by way of maintaining the associated rate of penetration (as indicated by the rate of movement of the drum on which the drill line is carried).

This represents a significant improvement over some old systems which utilized an air motor that would have to spin one shaft in the gearbox in one direction causing another perpendicular shaft to operate a pulley tied to a cable. Since the right angle design of gearboxes or old systems require motor rpm to cause a lifting of the brake handle, such a system is limited to how fast it can drill by the maximum rpm of the motor.

The use of this present system provides a number of advantages over presently available systems which may not be readily apparent, two of which are: (1) optimum weight-on-bit can be maintained quite precisely for any given drilling condition, thereby achieving maximum rate of penetration; and (2) precise and constant control of weight-on-bit avoids sudden, equipment-damaging torque changes.

In recent tests, the present driller system reduced rig "rotary torque" by 10 to 15 percent. This provides for improved ROP, decreased wear and tear on drill string joints and less unintended deviation in the drilled hole.

The addition of an encoder, described in more detail below, can provide an accurate feed back of the rig movements caused by the driller, and thereby provides several additional benefits: (1) it is an integral part of permitting the smooth drilling described above; (2) one is able to provide a display of the amount of footage drilled at any given point in time, how much footage since the last connection was made, and at what rate of penetration is being attained.

Users of the system of the present invention will be able to automate the process of "time drilling" which is used in virtually all directional and horizontal projects. Time drilling is a process used to start the deviated portion of a directional drilling operation. Through the use of mud motors and deviated sub connections deviation of the hole is started by drilling or moving the deviated bit forward for example, only one inch every five minutes. Currently this is performed by a human "driller" using a wrist watch and crude chalk markings on the "kelly" of the rig.

The present invention's system allows the directional drilling consultant to program the desired time and distance parameters and know that the work will be performed exactly to specifications resulting in a more accurate start to the directional portion of the project. This is a feature long requested among directional drilling personnel.

The information provided by the encoder and PLC also allows this driller to perform another function that is not available anywhere. "ROP Drilling" is exactly what it says—drilling only at a certain rate of penetration, even though the formation conditions could allow a faster rate. Some formations may be soft enough to be drilled at a fast rate, however other conditions such as gas pockets that need to be approached with caution to prevent a possible blow out, present the need for a driller that can control its ROP regardless of WOB. A variation of the before mentioned time drilling function allows this unit to perform this controlled "ROP Drilling".

The overall sensitivity of the present system enables it to achieve more precise corrections for weight on bit. This is especially important when there exists the need to follow the contour of a producing formation. Such sensitivity is also helpful when using downhole mud motors to prevent damage and ensure smooth operation. This same simplicity also facilitates the retrofitting of existing rigs and drilling equipment.

Still another advantage of the drilling system of the invention is its adaptability to monitor bit weight and/or bit torque and utilize one or both parameters as a determinix in the release of the drilling string. In such a fashion, selective control of downhole mud motors may be achieved.

Even more advantages of the invention will become obvious in light of the following detailed description of the preferred embodiments.

DETAILED DESCRIPTION OF THE PREFERRED EMBODIMENT

Figure 1:
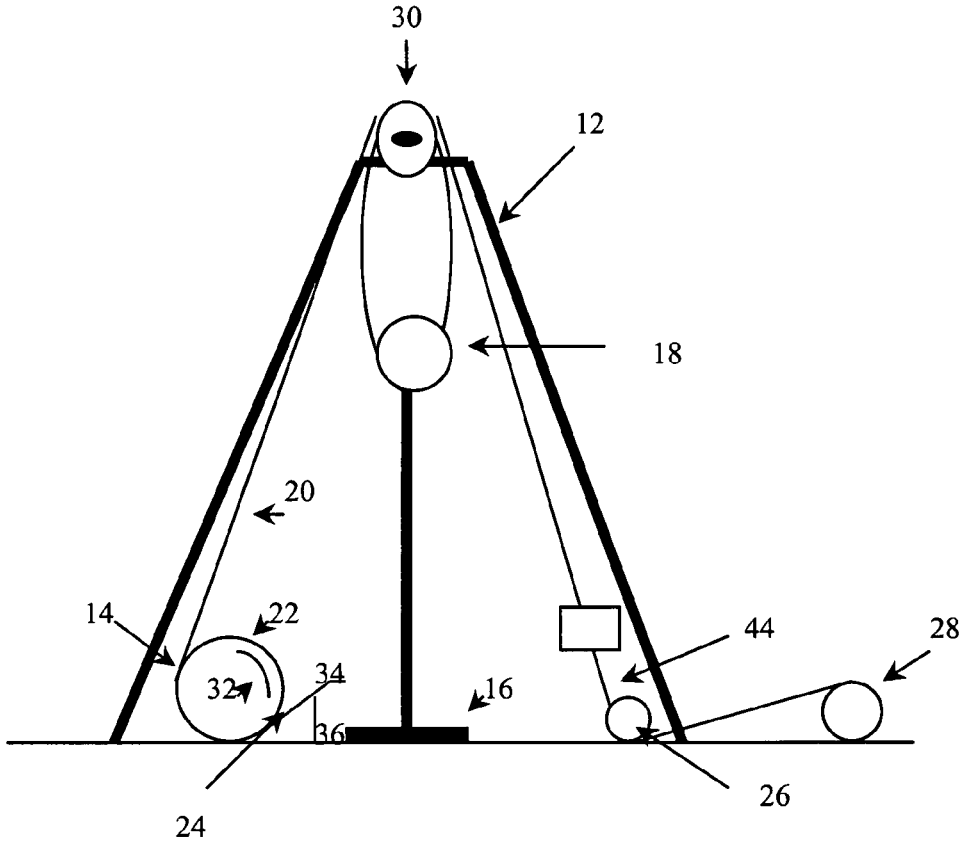
FIG. 1 illustrates a partial schematic, diagrammatic view of one embodiment of the drawworks control system of the present invention.
Figure 1:
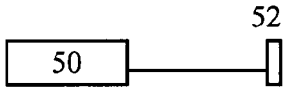

Referring to the figures, shown therein and referred by the numeral 10 is a draw works control system, constructed in accordance with the present invention.

For purposes of description, the draw works control system 10 is shown in combination with a conventional rotary drilling rig 12. The rotary drilling rig 12 consists of a draw works assembly 14 and a rotary drilling unit 16 which may be either a top drive or a table drive application. The draw works assembly 14 includes a traveling block 18 suspended from and applying tension to a cable 20. The cable 20 has one end thereof wound on a drum 22, the rotation of which is controlled by a power brake mechanism 24 and a prime mover, e.g. a diesel engine and/or a diesel-electric engine. The other end of the cable 20 is wound around an eccentrically mounted spool 26 and anchored to a storage drum 28. The intermediate portion of the cable 20 is maintained in an elevated position via a crown block 30 in a conventional manner as illustrated.

As will be appreciated by those skilled in the art, a conventional brake mechanism 24 is comprised of a brake band 32 engageable with the drum 22 via a brake lever 34, a brake lever biasing spring 36 connected between the brake lever 34 and a stationary rig or platform surface. It will be appreciated, however, that other braking systems may also be utilized in a manner consistent with the objectives of the invention.

Figure 2:
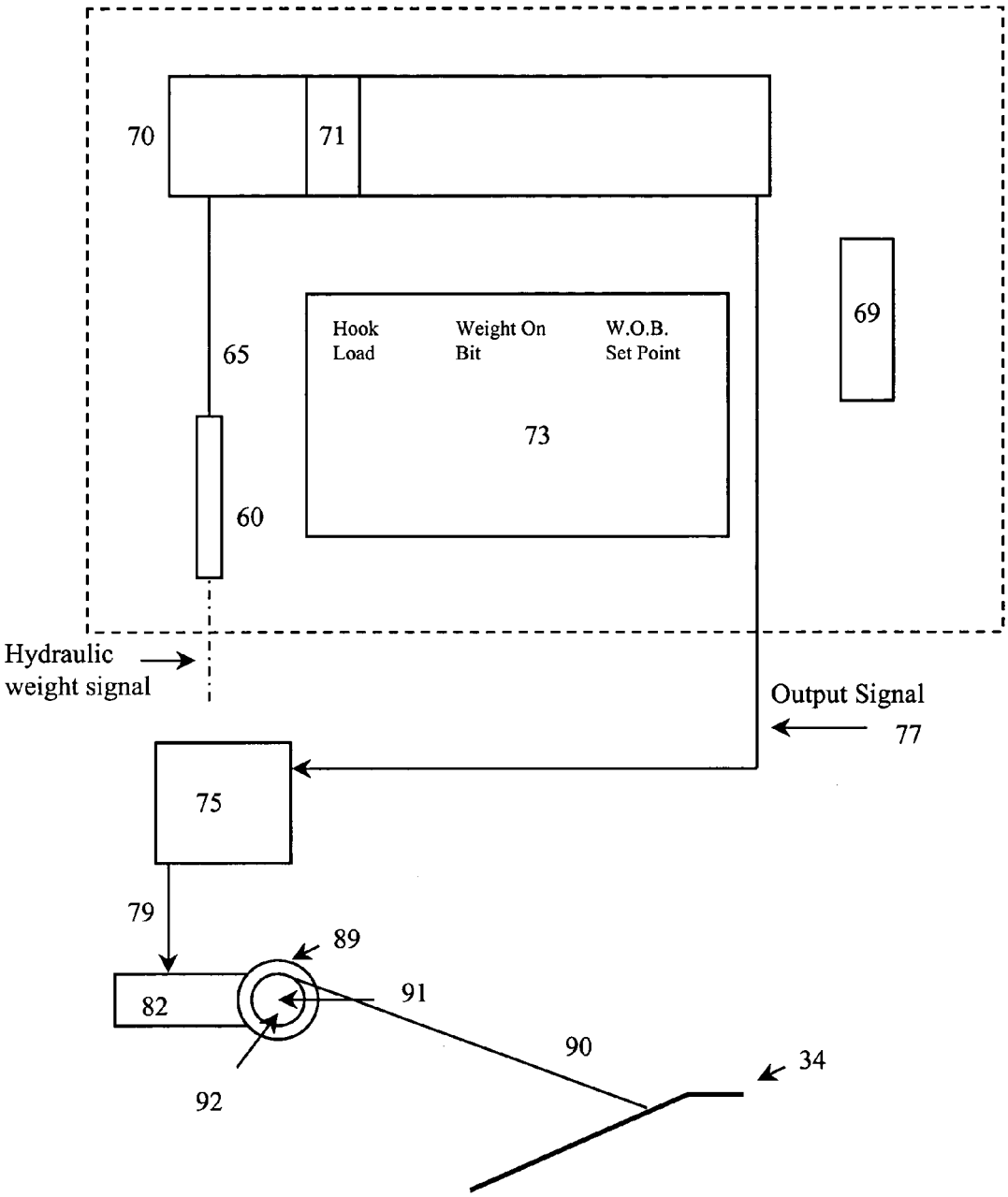
FIG. 2 illustrates a diagrammatic view of the system of FIG. 2.

The various elements comprising the draw works control apparatus illustrated in FIGS. 1 and 2 are designed to be supplied with clean, dry, pressurized air from a suitable air supply source 50 which conventionally includes an off-on switch 52. It is desirable in most applications to regulate the pressure of the air supplied to the various components comprising draw works control apparatus 10 by utilizing one or more regulators 54.

One preferred embodiment of the draw works control system of the present invention is illustrated in FIGS. 1 and 2. By reference, however, to FIGS. 3A and 3B, the system 10 includes a cable tension sensor assembly 41 which includes a sensor 44 and a transducer 65 to measure drill string weight. The sensor 44, which may be any one of a number of commercially available sensors, is connected to cable 20 and senses the tension, and hence drill string weight, of cable 20.

Figure 3A:
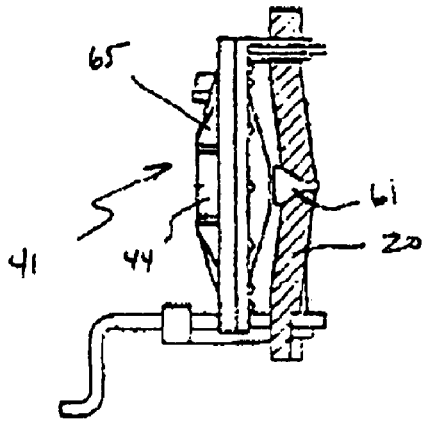
FIGS. 3A–B illustrate various types of exemplary weight sensor assemblies for use with the control system of the invention.
Figure 3B:
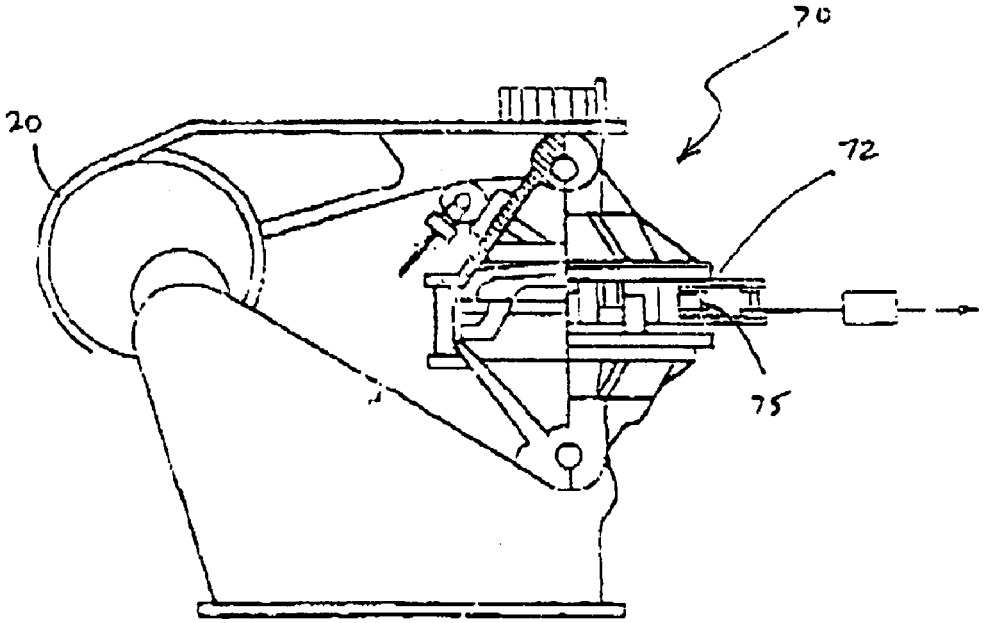

An exemplary sensor assembly 41 is illustrated in FIG. 3A in which is shown a sensor 44 coupled to a drilling line 20. As illustrated, sensor 44 includes a deflection plug 61 which acts on a diaphragm 65 which is filled with hydraulic fluid. A second anchor type tension sensor assembly 70 is illustrated in FIG. 3B in which is illustrated a sensor 72 which includes a diaphragm 75. In the case of each type of sensor assembly, an electrical output signal is created by the movement of the diaphragm which is acted on by the drill string 20. It will be appreciated that still other sensor assemblies 41 may also be utilized with the control system 10 of the invention.

Referring principally to FIGS. 2 and 3A, sensor 44 produces a 4–20 milliamps proportional output analog electrical signal, which is transmitted along electrical line 60 to a programmable logical controller ("PLC") 70, which preferably includes an analog to digital current converter 71, such as a current converter made by Automation Direct. Converter 71 converts the 4–20 milliamps proportional output analog electrical signal to a scaled digital signal, e.g. a signal with a discrete value from 0 to 4095. A power supply 69 supplies electrical power to electrical components such as the PLC 70.

The PLC 70 also receives an electrical signal representing a desired weight of bit ("WOB") input from a touch-screen monitor 73, on which the user may selectively enter or adjust the desired WOB or setpoint. The PLC, using program logic as will be explained below, then compares the current WOB (derived from the input from sensor assembly 41) to the desired WOB or set point. If the current weight on bit is less than the set point then the PLC will ramp up its digital output signal. This digital output signal will range from an output value of 0 to 4095.

The digital output signal is sent along a first signal path 77 to a variable frequency drive ("VFD") 75 which will, in turn, send a variable amount of alternating electrical current at a variable frequency along a second signal path 79 to an electric motor 82. In this way, the amount of current sent to the electric motor 82 (and, accordingly, its RPM) will depend on the value of the output signal from the PLC 70.

The electric motor 82 drives a conventional draw works gearbox 89 with a clutched cable reel 92 rotatably carried on an output shaft 91. Cable reel 92 carries cable 90 which, in turn, is attached to brake handle 34, in the conventional manner. Quite contrary to convention, however, electric motor 82 drives gearbox 89 continuously, at a nearly constant RPM. This is in stark contract to conventional systems which dramatically ramp up and ramp down the speed of the gearbox for attempting to stay within rate of penetration settings. Such lack of precision in conventional systems is the product of a lack of precision feedback and control of the present system, and of the use of conventional air motor drives for draw works gearboxes, which, of course, cannot be controlled with any precision.

The RPM of electric motor 82 is, as mentioned above, the product of the signal output of VFD 75 and, for reasons described hereafter, will be that substantially constant rate which optimally maintain the ROP which will, in turn, assure the desired WOB.

PLC 70 continuously compares the desired WOB to the extrapolated WOB and adjusts the RPM of motor 82 in such a way that, when balanced against the mechanical effect of movement of drum 22 via a conventional drum unit, flexible shaft and overriding clutch mechanism (not shown separately in the drawings), cable 90, and with it, brake handle 34 are drawn to a degree that the desired WOB, via precise management of the ROP is maintained. In other words, by substantially, constantly measuring the WOB, and adjusting the RPM of motor 82, PLC 70 ensures that a substantial state of equilibrium exists between the tension on cable 90 and brake handle 34 and the opposite tending forces of the mechanical feedback from movement of drum 22 such that the desired ROP and WOB are constantly assured.

The precise management of RPM of electric motor 82, and with it, all the desired parameters described above, is achieved by certain functionalities which are products of the software or firmware by which PLC 70 operates. PLC 70 has, as mentioned above, an output range of 0–4095. When the WOB setpoint and actual WOB match, the output is 0. However, as WOB decreases (as earth is drilled away from under the drill bit) PLC output increases.

The principle operation of the PLC 70's software or firmware is summarized as follows: The program works on X range of weight variance from the setpoint representing the maximum PLC output. For example let us say that at one point in time, the PLC has the range set to 10 which represents 10,000 lbs of variance below the setpoint. If 30,000 lbs is the desired WOB, then 4095 output would be attained at 20,000 lbs WOB. One should never actually reach 4095 in output during normal drilling, because the system would correct for such a variance before reaching that point (no more than 500 lbs. WOB variance from either side of the setpoint).

Now, let us say that drilling is occurring at a 35 foot per hour rate, and the output of the PLC is averaging in the range of 800 output. This results in the hertz range out to the motor averaging in the range of 18 hz. So, for this ROP (35 fph) a hertz output in the range of 18 will keep the rig within 500 lbs of the setpoint.

If drilling rates were to never change, nothing else would be necessary. However, such is not the case. ROP changes constantly, and so the driller too needs to constantly change to keep the smooth drilling pace both at faster and slower rates.

The PLC is constantly monitoring the relationship between WOB and WOB setpoint. PLC 70 can be set to make adjustments to the range up or down according to that relationship every 0.3 seconds. Returning to our example: suppose the drill bit encounters slightly softer formation and the earth drills away faster causing a loss of WOB. Now, in order to maintain the desired WOB, one needs to drill faster (increase the ROP).

By repeatedly comparing setpoint WOB to actual WOB, the PCL 70 will detect this change of circumstance. Let us use a 150 lbs. as a detected variance from setpoint after the softer strata is encountered. PLC 70 will then subtract 300 lbs (as an example, depending on programming) from the above mentioned range of 0–10,000 lb variance range. Now 4095 of output would theoretically happen at 9,700 lbs away from the setpoint, rather than the earlier 10,000 lbs. With the reduction of the overall range, the output at approximately 500 lbs. away may now average 850 in PLC output, resulting in average hz. output of the VFD being 20 hz. This results in more gearbox speed and therefore more ROP. The PLC will continue to decrease the overall range as long as the WOB remains below the setpoint. Then, when the WOB is over the setpoint, the opposite process begins, causing a increase in range and a reduction in hertz output per lb. away from the setpoint. In this format the WOB will float slightly above and below the setpoint maintaining that constant drilling or "peel" but at the same time keep the variance from set point with 500 lbs. to either side.

Programming to achieve the above results are well within the skills of a competent programmer upon reference to this disclosure, and actual code examples or routines are not required for present purposes.

One additional aspect of the PLC logic deserves mention: If one considers the above basic premises, one would suspect that when WOB is at zero variance from the WOB setpoint the PLC output would be zero, and the electric motor 82 and the attached gearbox 89 would, therefore, be stopped and then spin up as the WOB fell below the setpoint. That is the way drillers of the past would operate, and the result was very much less than optimal smoothness of operations.

Because there should be a certain amount of gearbox rotation to move the brake handle to any degree, one should maintain some degree of output or "lead" in the range so that the right gearbox rpm can be attained with minimal variance from the setpoint. In other words, if PLC 70 has determined from the example above that a 9,700 lbs variance range is required to provide the needed hertz and rpm for the given conditions, PLC 70 may shift 2000 lb. of that range above the setpoint and leave the remaining 5700 lb. below the setpoint. That way, one attains the desired 850 PLC output and 20 htz. output to achieve the necessary rpm basically at the setpoint. This way, as stated above, the WOB will float slightly above and below the setpoint, thereby maintaining the desired constant "peel"—gearbox 89, and therefore, the action of the brake handle 34 never stops.

A system including the above-described features and components provides a number of benefits not previously available in the art. As mentioned above in more detail, these benefits, when compared to existing driller control system technology, include: (1) more precise and consistent control of weight-on-bit; (2) smoother transitions between weight-on-bit settings; (3) more precise information feedback for monitoring depth of drilling, time for component change-out, etc.; and (4) elimination of driller control system limitations on rate of penetration.

Figure 4:
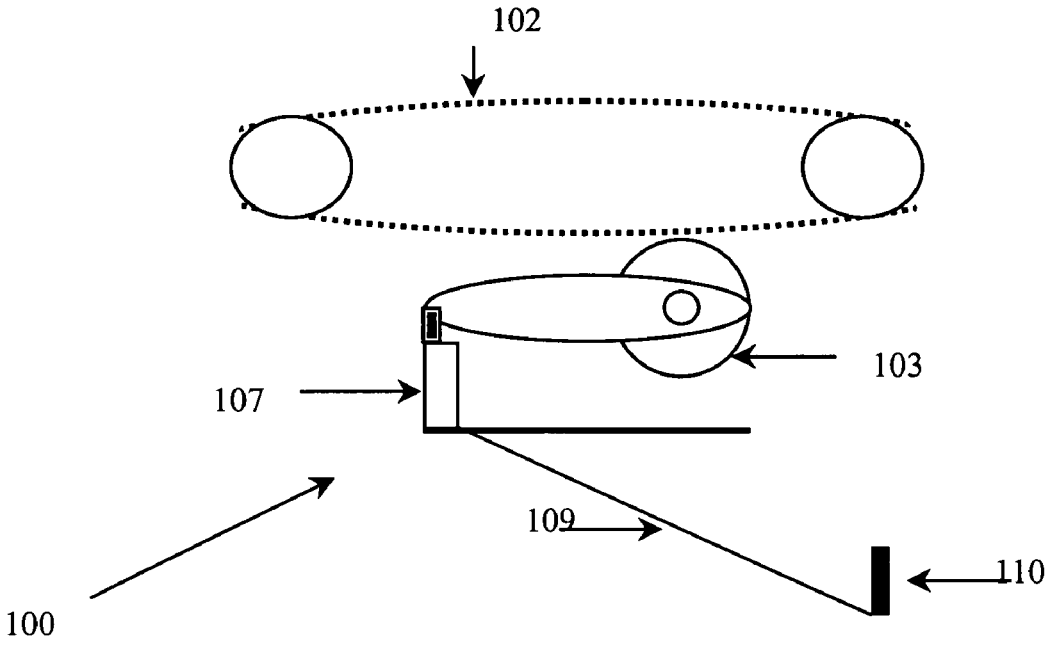
FIG. 4 illustrates a schematic, partially diagrammatic view of one embodiment of a torque sensor which may be used in conjunction with the control system of the invention.

By reference to FIG. 4, in a rotary table system utilizing a non-electric power source, e.g. a diesel engine (not shown), a hydraulic signal is taken from an idler wheel tension sensor 100 which in turn is coupled to a transducer, e.g. a transducer as manufactured by M.D.—Totco. Sensor 100 mounts against the drive chain 102 such that idler wheel 103 is disposed in contacting relation to said chain 102, as illustrated. Thus, as drive chain 102 rotates, pressure is applied against wheel 103 which in turn applies pressure to hydraulic piston 107, thereby increasing the fluid pressure within the hydraulic line 109. Hydraulic line 109 in turn is coupled to a transducer 110.

Transducer 110 sends an electric signal to a PLC, with an appropriate input, the specifics of which would be readily apparent to anyone reasonably skilled in the field upon reference to this disclosure. An increase in hydraulic signal as reported to the PLC will be interpreted as an increase in hook load and therefore a decrease in WOB. Therefore, the electrical signal would, in that condition, then be increased to create gearbox movement to increase the WOB.

As described above with respect to bit weight, the PLC with its touch-screen input, allows the operator to set desired parameters for tool torque. If the measurement of this parameter below the set value, the PLC ramps up the output signal and conversely if the WOB is greater than the set point the PLC will ramp down the output signal, all resulting in the change of WOB, and, therefore, the torque in the manner described elsewhere herein.

Incorporating the features and components of the present invention's system into conventional drilling apparatuses and equipment are well within the skill of those in the art, upon reference to this description. In addition, selection of specific components to meet the descriptions and functionalities referenced herein are also within the reasonable skills of those in the art, once provided with this description.

Although particular detailed embodiments of the apparatus and method have been described herein, it should be understood that the invention is not restricted to the details of the preferred embodiment. Many changes in design, composition, configuration and dimensions are possible without departing from the spirit and scope of the instant invention.

What is claimed is:

1. An automatic drilling system for regulating the release of a drill string of drilling rig during the drilling of a borehole, comprising:

a drill stem having a drill bit at one end;

drawworks coupled to said drill system;

a prime mover engaged to said drawworks to cause said drawworks to alternatively move said stem upward and downward;

a bit weight sensor configured for measuring bit weight through direct interface with bit support means which, at least in part, supports the weight of said drill bit, and which is electrically coupled to a electronic bit weight comparison means, where said bit weight comparison mens compares actual bit weight indicated by said bit weight sensor against a user-selected, bit weight value set into said electronic bit weight comparison means, and generates a signal proportionate to any difference between said actual bit weight and said pre-selected bit weight value;

programmable control means operatively coupled to a variable drive electric motor which is interfaced with drill stem braking means to proportionately effect movement of said drill string in said upward or downward direction upon receipt of signals from said electronic bit weight comparison means according to the value of said signal.

2. The automatic drilling system of claim 1 where the electronic bit weight comparison means includes a programmable logical controller.

3. A control system for governing drawworks braking in an earth drilling apparatus which includes a drill stem comprising:

sensor means for measuring weight-on-bit of said drill string configured for measuring bit weight directly through interface with bit support means which, at least in part, supports the weight of said drill bit, and for generating an electronic signal proportionate to measured weight-on-bit during a drilling operation;

electronic weight-on-bit comparison means comprising:

computer and memory means for storing program logic, data received from said sensor, and user input data;

user input means for inputting said user input data which is representative of a desired weight-on-bit for a drilling operation;

signal input means for receiving said electronic signal from said sensor means and for storing data representative of said electronic signal;

motor control signal output means for generating a variable motor control signal which is proportionate to a desired speed of operation of an electric motor operatively connected to said motor control signal output means;

computer data and program processing means for comparing said user input data against said data representative of said electronic signal and generating a motor control command for sad motor control signal output means, operably connected to said computer data and program processing means, to generate said variable motor control signal in proportion to any measured weight-on-bit; and an electronic motor operatively connected to said motor control signal output means and, via a gearbox, to braking means for, depending on the RPM rate of said electric motor, moving said braking means at proportional rates for controlling weight-on-bit upwardly or downwardly during a drilling operation, and RPM rate of said electric motor being governed by and proportionate to said motor control signal.

* * * * *